United States Patent [19]

Katakura et al.

[11] 4,361,397

[45] Nov. 30, 1982

[54] CLEANING APPARATUS FOR AN ELECTROSTATIC RECORDING MACHINE

[75] Inventors: Hiroshi Katakura; Tomio Arai, both of Hachioji, Japan

[73] Assignee: Konishiroku Photo Industry Co., Ltd., Tokyo, Japan

[21] Appl. No.: 181,870

[22] Filed: Aug. 27, 1980

[30] Foreign Application Priority Data

Aug. 31, 1979 [JP] Japan ..... 54-110446

[51] Int. Cl.[3] ..... G03G 15/09; G03G 21/00

[52] U.S. Cl. ..... 355/15; 118/652; 355/300

[58] Field of Search ..... 355/3 R, 3 DD, 15; 118/652

[56] References Cited

U.S. PATENT DOCUMENTS 3,754,962 8/1973 Berlier et al. ..... 355/3 DD X
3,914,045 10/1975 Namiki et al. ..... 355/3 DD X
3,967,892 7/1976 Whited ..... 355/3 DD
3,985,099 10/1976 Nagashima et al. ..... 355/3 DD X
4,292,387 9/1981 Kanbe et al. ..... 355/3 DD X

*Primary Examiner*—Fred L. Braun
*Attorney, Agent, or Firm*—Jordan B. Bierman; Linda G. Bierman

[57] ABSTRACT

An improved cleaning apparatus for a copying machine includes, in addition to a conventional magnetic brush-type device in which a rotatable sleeve partially immersed in developer surrounds a group of magnets, a magnetic member disposed immediately upstream of the normal cleaning position at which the magnetic brush sleeve is brought into predetermined proximity with the photosensitive member. The magnetic member is located closely adjacent the surface of the photosensitive surface so that residual developer particles remaining on the photosensitive surface are magnetically attracted to the magnetic member prior to and for the purpose of supplementing conventional magnetic brush cleaning immediately downstream therefrom.

5 Claims, 2 Drawing Figures

CLEANING APPARATUS FOR AN ELECTROSTATIC RECORDING MACHINE

BACKGROUND OF THE INVENTION

The present invention relates to a cleaning apparatus for an electrostatic recording machine—such, for example, as an image transfer type electrophotographic copier—and particularly to an improvement in an apparatus used for both developing and cleaning.

In an image transfer type electrophotographic copying machine, an original to be copied is illuminated by light, the light reflected from the original is projected onto a photosensitive substance, and an electrostatic latent image is thereby formed on the photosensitive substance. This electrostatic latent image is then developed by a developing agent containing toner to produce a visible or toner image, the visible image being thereafter transferred onto a transfer paper and then fixed, whereby a copy image of the original is formed on the transfer paper. In an electrophotographic process of this type, toner remains on the surface of the photosensitive substance even after the image transfer process has been completed. Since this toner residue will cause stains to appear on an image produced in the next succeeding electrophotographic process, it must be removed from the surface of the photosensitive substance prior to further copying. An apparatus furnished for this purpose is commonly referred to as a cleaning apparatus, of which a variety of systems—including those using blades, feathers and magnetic force—are already known.

In a copying apparatus utilizing developer powder of a two-component system containing toner and carrier, the prior art teaches that development and cleaning may be carried out by the same device to simplify the copier structure. Such an arrangement is certainly advantageous in providing simplified structure and enabling efficient use of the developing toner without needless waste.

However, it has been found that an increased content of toner relative to carrier content results in decreased cleaning effectiveness, and further that the self-cleaning capability of the toner is successively reduced due to fatigue of the developer toner.

With a view to eliminating the foregoing disadvantage, the so-called two-revolution-one-copy type copying machine has been developed. This type of machine uses a single component developer comprising magnetic toner (and coloring agent if required) contained in resin, and also uses a revolving drum which produces a single copy for each two full revolutions thereof.

FIG. 1 illustrates a schematic construction of this type of copying machine, wherein a movable original table 2 is provided on the upper surface of a copying machine body 1. An original 3 placed on original table 2 is illuminated by an exposure lamp 4, and the light reflected from original 3 is directed by a mirror 5 and a lens 6 onto a photosensitive layer 7*a* laminated about the surface of a revolving drum 7. Successively disposed about photosensitive layer 7*a* are a charging electrode 8 for uniformly charging photosensitive layer 7*a*, an electric neutralizing lamp 9 for neutralizing residual electric charge remaining on photosensitive layer 7*a*, a developing and cleaning apparatus 10 for both developing the electrostatic latent image formed on photosensitive layer 7*a* and removing residual toner from the photosensitive layer, an image transfer electrode 11 for causing the toner image formed as a result of development to be transferred onto a transfer paper P, and a separation apparatus 12 for separating transfer paper P from photosensitive layer 7*a*. Transfer paper P is stored in a paper feeding tray 13 which is provided in machine body 1, is fed by a feed roller 15 synchronized with the copying operation, and is further conveyed to the image transfer position by a paper feeding roller 14. Separating apparatus 12 separates the transfer paper from photosensitive layer 7*a* after completion of image transfer, the paper P thereafter being conveyed to a fixing apparatus 16 to be heat fixed and then delivered to a tray 17 on the outside of the machine.

In this type of machine, drum 7 begins its rotation at the commencement of the copying operation. During the first rotation of the drum its photosensitive layer 7*a* is electrically charged and receives an electrostatic latent image by light exposure of the original, the latent image is developed to a toner image which is then transferred onto transfer paper, and the paper is separated from the photosensitive layer. During the next or second rotation of the drum, the residual electric charge is removed from photosensitive layer 7*a*, and toner remaining on the drum surface is cleaned therefrom. Thus, one copying operation is completed by two full rotations of the drum.

If a magnetic brush type combination developing and cleaning apparatus is utilized in such an image transfer type electrophotographic copying machine, there may arise a danger of incomplete cleaning operation. Still referring to FIG. 1, the magnetic brush type combination developing and cleaning apparatus 10 comprises a rotatable sleeve 10*b* which is partially immersed in developer D contained in a developer container 10*a*, and a group of fixed magnets 10*c* are arranged within sleeve 10*b*. Sleeve 10*b* is disposed adjacent photosensitive layer 7*a*. In such a magnetic brush type developing and cleaning apparatus, development occurs when tufts or ears of the developer, which are formed on the surface of sleeve 10*b* by sleeve rotation, lightly contact an electrostatic latent image formed on photosensitive layer 7*a* and are electrostatically attracted thereto. Thus, a gap on the order of 1–5 mm (1.0–1.5 mm in the case of single component developer; 1–5 mm in the case of two component developer) should be provided between photosensitive layer 7*a* and sleeve 10*b* to enable formation of the ears or tufts of developer. During cleaning, on the other hand, residual toner on photosensitive layer 7*a* is attracted by the magnetic attraction force of magnets 10*c* within sleeve 10*b*, the residual toner being thereby separated and removed from the surface of layer 7*a*. The cleaning function may accordingly be weakened due to the presence of the gap. Moreover, the thickness of sleeve 10*b* may adversely affect the magnetic cleaning function. As a consequence, where copying machines utilize a single magnetic brush type developing and cleaning apparatus, there is a possibility that the cleaning effect might not be satisfactorily obtainable.

An electrophotographic copying apparatus of the dry toner image transfer type is proposed in U.S. Pat. No. 2,918,808 wherein a blade means is disposed anterior of a magnetic brush such that its forward end portion is brought into pressing engagement with the surface of the photoreceptor at least during its second revolution to aid cleaning by the magnetic brush. In this case, however, the material and contact pressure force of such a blade means must be carefully selected so as not to affect the electric charge impressed on the photoreceptor during its first revolution; alternatively, the forward end portion of the blade means should be moved out of engagement with the surface of the photoreceptor during the first revolution and into pressing engagement therewith during the second revolution.

SUMMARY OF THE INVENTION

The present invention is intended to remedy the foregoing problems, and provides an improved magnetic brush type developing and cleaning apparatus incorporating a cleaning means arranged just upstream of the magnetic brush developing and cleaning position or zone at which the rotating sleeve defines a predetermined gap with respect to the photosensitive member encircling the drum.

DETAILED DESCRIPTION OF THE PREFERRED EMBODIMENT

Figure 1:
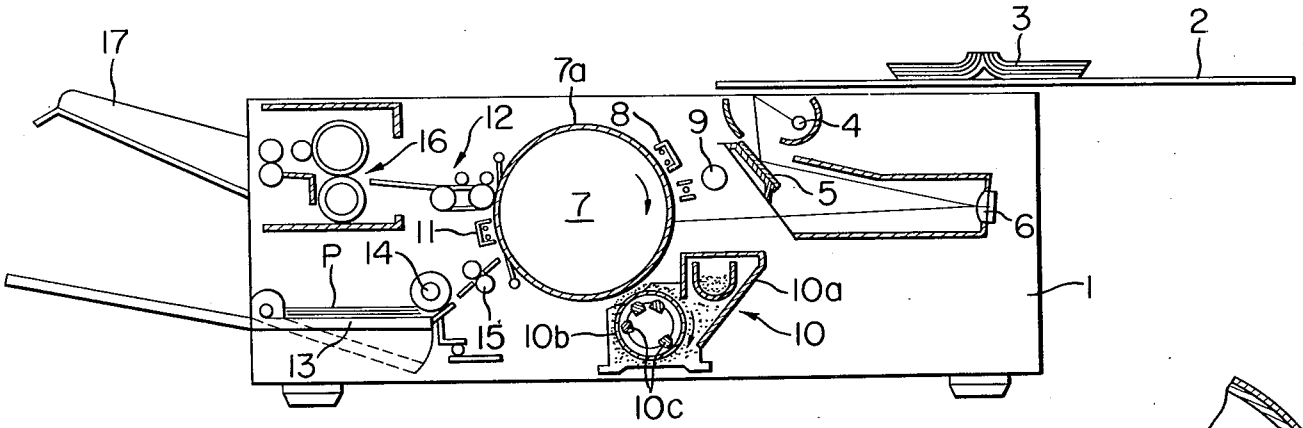
FIG. 1 is a schematic, constructural depiction of a two-revolution-one-copy type image transfer electrophotographic copying machine to which the present invention is applicable.
Figure 2:
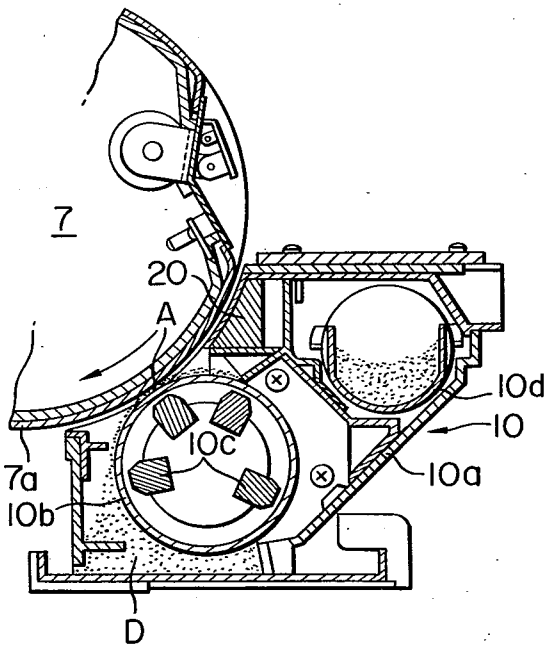
FIG. 2 is a diagrammatic view of the principal part of a developing and cleaning apparatus constructed in accordance with the teachings of the invention.

FIG. 2 is a diagrammatic illustration of a developing and cleaning apparatus in accordance with the invention, and wherein the reference numerals which are the same as in FIG. 1 indicate the same or corresponding constructural parts and elements.

A magnetic bar 20 extending parallel to the widthwise direction of revolving drum 7 (orthogonal to the FIG. 2 drawing) is disposed in the housing of apparatus 10 above or upstream of the developing and cleaning position A at which the predetermined gap between sleeve 10*b* and photosensitive layer 7*a* is defined. Magnetic bar 20 is so arranged as to extend over and close to photosensitive layer 7*a*. The gap between magnetic bar 20 and the photosensitive layer 7*a* is preferably as narrow as possible, taking into account possible peripheral irregularities and eccentricity of revolving drum 7, and may, as a practical matter, be set on the order of approximately 0.5–1 mm. The trough shaped container 10*d*, which is fitted within developer container 10*a*, is a toner supplier.

As noted, magnetic bar 20 is so set that it extends over and close to photosensitive layer 7*a*. Toner remaining on photosensitive layer 7*a* is thus initially magnetically absorbed and removed by magnetic piece 20 when drum 7 begins its second revolution in a copying operation, and any subsequently remaining toner is further swept and removed from layer 7*a* both by the magnetic absorption force of magnets 10*c* in revolving sleeve 10*b* of the conventional developing and cleaning apparatus, and also by the ears of developer which are formed on sleeve 10*b*. Magnetic piece 20 is further arranged so that the toner removed thereby may fall into the developing and cleaning apparatus when magnetic piece 20 can no longer retain it. In addition, it would be convenient to automatically return a portion of the toner removed by magnetic piece 20 into container 10*a* or toner supplier 10*d*.

As described, the present invention enables a two-revolution-one-copy type electrophotographic copying machine using a magnetic brush type developing and cleaning apparatus to effectively provide a reliable and adequate cleaning operation and effect. This is accomplished by placing a magnetic member or piece on the upper reaches of the developing and cleaning apparatus, upstream of the developing and conventional cleaning position. It should be recognized and understood that the present invention can be applied not only to an electrophotographic copying machine utilizing a revolving drum such as shown in the preceding example, but also to an electrophotographic copier incorporating an endless belt.

Although the foregoing description referred specifically to a magnetic brush type developing and cleaning apparatus, the present invention can likewise be applied to a magnetic brush type cleaning apparatus without limitation to the aforementioned type of apparatus.

What is claimed is:

1. In an improved magnetic brush type apparatus for cleaning residual developer from the surface of a moving electrostatic image receiving member in an electrostatic recording machine, wherein the cleaning apparatus includes a sleeve disposed to define a predetermined gap between the sleeve and the member surface at a cleaning position at which residual developer on the member surface is attracted therefrom to the sleeve, the improvement comprising:

a magnetic member disposed in said cleaning apparatus upstream of the cleaning position and in predeterminately close proximity to the surface of the electrostatic image receiving member for magnetically attracting residual developer from the surface of the image receiving member in advance of and to supplement magnetic brush cleaning of the member surface immediately downstream of said magnetic member at the cleaning position, whereby the surface cleaning efficiency of the cleaning apparatus is notably enhanced.

2. In an improved cleaning apparatus in accordance with claim 1, said predeterminately close proximity of the magnetic member to the surface of the image receiving member comprising a spacing therebetween of 0.5 to 1 mm.

3. In an improved cleaning apparatus in accordance with claim 1 and wherein the electrostatic image receiving member has a width defined perpendicular to its direction of movement, said magnetic member extending for substantially the full width of the image receiving member.

4. In an improved cleaning apparatus in accordance with claim 1 and wherein the apparatus further includes a reservoir of developer in which the sleeve is at least partially immersed, said magnetic member being so disposed in the cleaning apparatus and with respect to the reservoir that developer particles attracted to said magnetic member from the surface of the image receiving member and in excess of the amount capable of being magnetically held by said magnetic member drop into the reservoir for reuse.

5. In an improved cleaning apparatus in accordance with claim 1, the improved magnetic brush type apparatus being additionally available for use in developing an electrostatic image on the image receiving member.

* * * * *